US008312587B2

(12) United States Patent
Chen

(10) Patent No.: US 8,312,587 B2
(45) Date of Patent: Nov. 20, 2012

(54) SELF-ROTATING MOP

(76) Inventor: I-Huang Chen, Pateh (TW)

( * ) Notice: Subject to any disclaimer, the term of this patent is extended or adjusted under 35 U.S.C. 154(b) by 415 days.

(21) Appl. No.: 12/756,494

(22) Filed: Apr. 8, 2010

(65) Prior Publication Data

US 2011/0247163 A1 Oct. 13, 2011

(51) Int. Cl.
*A47L 13/20* (2006.01)

(52) U.S. Cl. ..... 15/228; 15/229.1

(58) Field of Classification Search ..... 15/228, 15/229.1, 229.6, 147.1, 147.2
See application file for complete search history.

(56) References Cited

U.S. PATENT DOCUMENTS 8,220,101 B2 * 7/2012 Chen ..... 15/119.1
2011/0214241 A1 * 9/2011 Wang ..... 15/228
* cited by examiner

*Primary Examiner* — Shay Karls
(74) *Attorney, Agent, or Firm* — C. G. Mersereau; Nikolai & Mersereau, P.A.

(57) ABSTRACT

A self-rotating mop has a mop head, a rotating rod, an actuating assembly and a top pole. The rotating rod is connected securely to the mop head and has spiral channel. The actuating assembly is mounted between the rotating rod and the top pole and has an actuating sleeve and an actuating ring. The actuating sleeve has multiple upper ratchets, and the actuating ring has multiple lower ratchets and multiple curved ribs. The curved ribs of the actuating ring engage the spiral channel of the rotating rod. When the top pole is pushed downward, the upper and lower ratchets engage with each other to force the rotating rod to rotate and move upward. When the top pole is pulled upward, the upper and lower ratchets disengage with each other and the actuating ring is rotated to allow the top pole for moving upward.

16 Claims, 14 Drawing Sheets

SELF-ROTATING MOP

BACKGROUND OF THE INVENTION

1. Field of the Invention

The present invention relates to a self-rotating mop, especially to a self-rotating mop for cleaning.

2. Description of the Prior Arts

Mops are widely used in daily cleaning. A mop comprises a skeleton and multiple bristles connected with each other. The user holds the skeleton and utilizes the bristles to clean the floor. The dirty bristles are washed in a mop bucket and are twisted to squeeze out the water, but twisting the bristles needs to directly contact the bristles of the mops. Directly contacting the bristles of the mops dirties the users' hands. Therefore, a self-rotating mop is invented with a mop bucket. The conventional self-rotating mop has rotating structures to allow the skeleton and bristles to self rotate when the skeleton is pressed downward. With the rotatable basket in the mop bucket, the bristles are spun to remove the redundant water from the bristles. However, the rotating structures of the conventional self-rotating mop are complicated to increase the cost and the manufacturing difficulty.

To overcome the shortcomings, the present invention provides a self-rotating mop to mitigate or obviate the aforementioned problems.

SUMMARY OF THE INVENTION

The main objective of the present invention is to provide a self-rotating mop with simplified structure. The self-rotating mop has a mop head, a rotating rod, an actuating assembly and a top pole. The rotating rod is connected securely to the mop head and has spiral channel. The actuating assembly is mounted between the rotating rod and the top pole and has an actuating sleeve and an actuating ring. The actuating sleeve has multiple upper ratchets, and the actuating ring has multiple lower ratchets and multiple curved ribs. The curved ribs of the actuating ring engage the spiral channel of the rotating rod. When the top pole is pushed downward, the upper and lower ratchets engage with each other to force the rotating rod to rotate and move upward. When the top pole is pulled upward, the upper and lower ratchets disengage with each other and the actuating ring is rotated to allow the top pole for moving upward.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
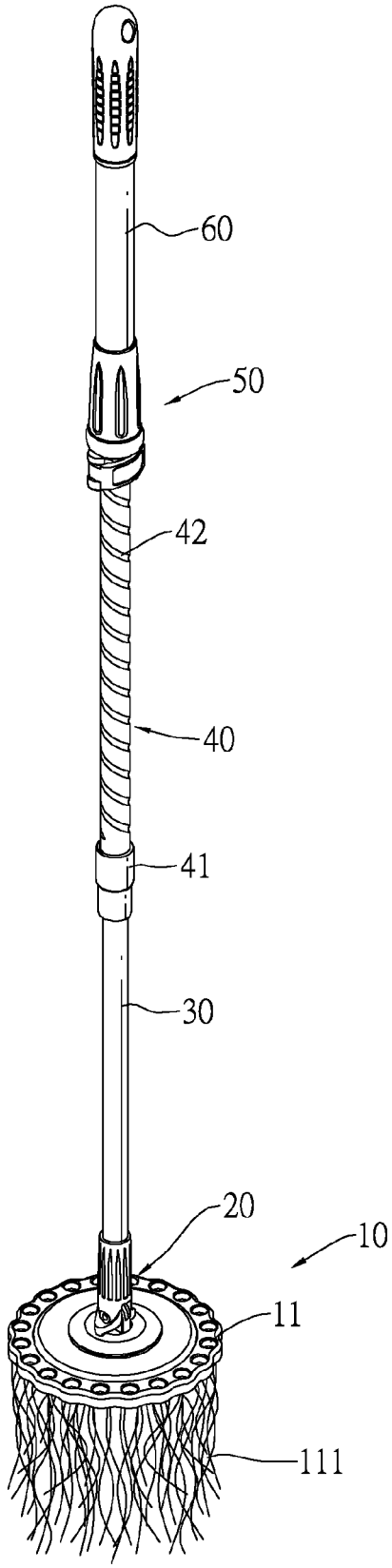
FIG. 1 is a perspective view of a self-rotating mop in accordance with the present invention.
Figure 2A:
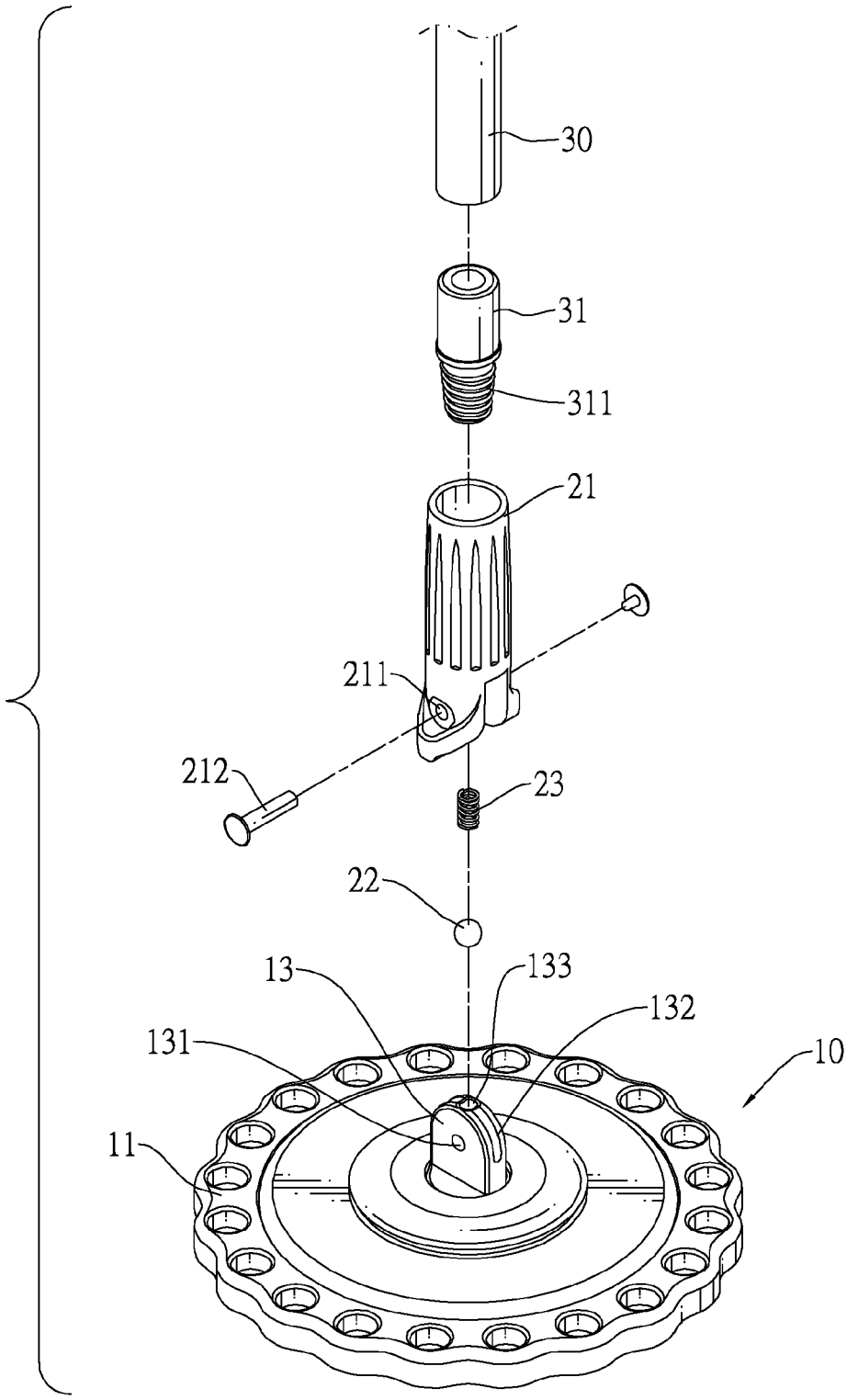
FIG. 2A is a partially exploded perspective view of the self-rotating mop in FIG. 1.
Figure 2B:
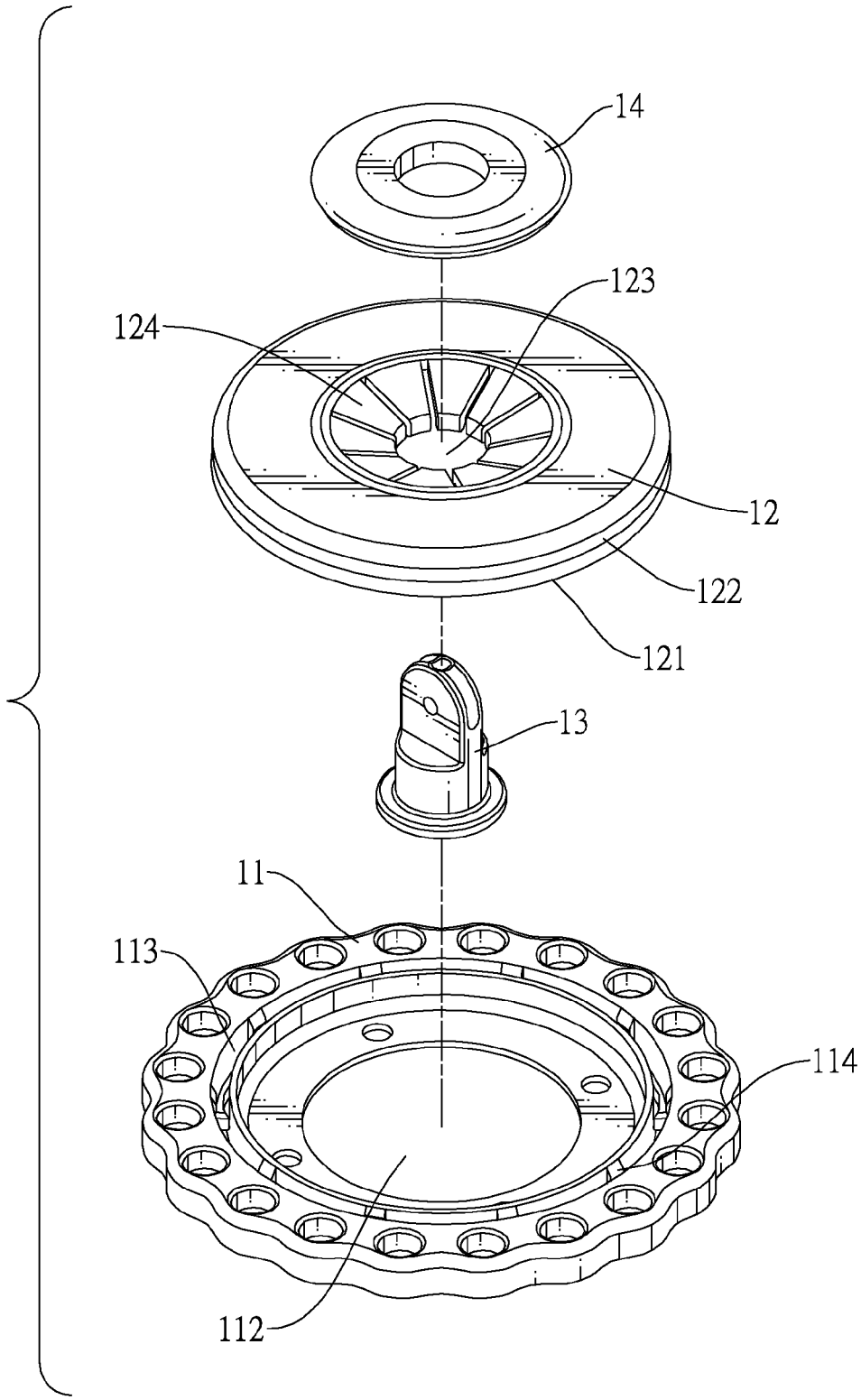
FIG. 2B is an exploded perspective view of a mop head of the self-rotating mop in FIG. 1.
Figure 2C:
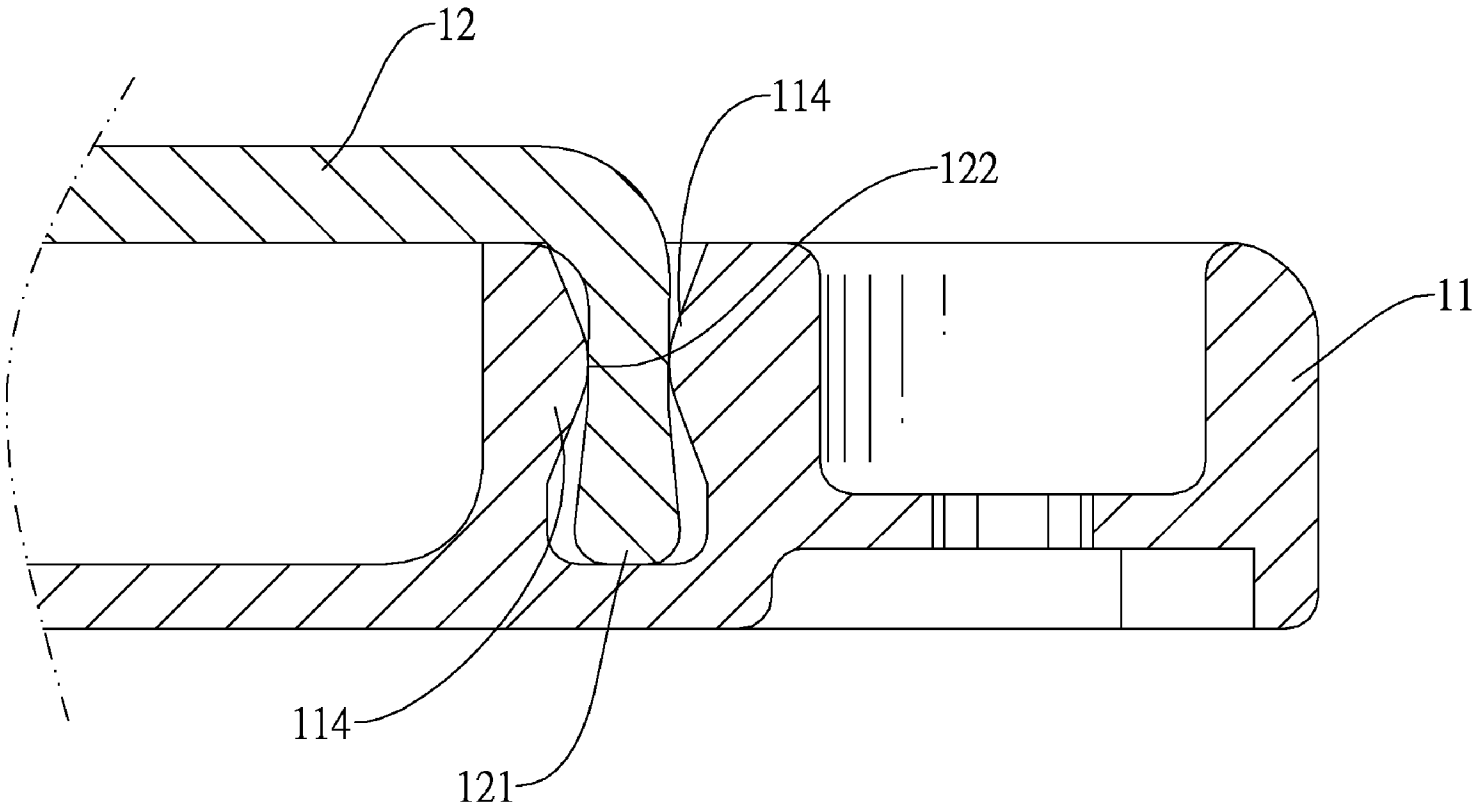
FIG. 2C is an enlarged side view in partial section of the mop head in FIG. 2B.

With reference to FIG. 1, a self-rotating mop head in accordance with the present invention comprises a mop head (10), a pivoting assembly (20), a connecting rod (30), a rotating rod (40), an actuating assembly (50) and a top pole (60).

With reference to FIGS. 1, 2A, 2B, 2C and 3, the mop head (10) comprises a base (11), a mounting disc (12), a pivoting seat (13) and a lid (14). Multiple bristles (111) are mounted on a bottom of the mop head (10) and may be mounted on a bottom of the base (11).

The base (11) has a central hole (112), a mounting channel (113) and multiple holding protrusions (114). The mounting channel (113) is formed annularly in a top surface of the base (11) and is formed around the central hole (112). The holding protrusions (114) are formed in the mounting channel (113) in pairs. The base (11) may have an irregular sidewall for decoration.

The mounting disc (12) is covered on the top surface of the base (11) and has a sidewall (121), two grooves (122), a central hole (123) and multiple pawls (124). The sidewall (121) protrudes into the mounting channel (113) of the base (11) and is clamped by the holding protrusions (114). The grooves (122) are formed annularly in an inner surface and an outer surface of the sidewall (121) and engages with the holding protrusions (114). The central hole (123) of the mounting disc (12) aligns with the central hole (112) of the base (11).

When the self-rotating mop in accordance with the present invention is used for cleaning, a slanted force acts on the mounting disc (12) to force the holding protrusions (114) of the base (11) clamping the sidewall (121) of the mounting disc (12). Therefore, the mounting disc (12) is kept from departing from the base (11) when the self-rotating mop is used. When the user needs to change the base (11) for replacing new bristles (111), a perpendicular force acts on the mounting disc (12) to pull the mounting disc (12) departing from the base (11).

The pawls (124) are formed separately on and protrude transversely from an inside wall around the central hole (123) of the mounting disc (12). The pivoting seat (13) is mounted through the central hole (123) of the mounting disc (12), protrudes through a top surface of the mounting disc (12) and is clamped between ends of the pawls (124). The pivoting seat (13) is rotatable relative to the mounting disc (12) when a slanted force acts on the pivoting seat (13). The pivoting seat (13) is secured to the mounting disc (12) when a perpendicular force acts on the pivoting seat (13) to press down the pawls (124) so that the pawls (124) grasp the pivoting seat (13).

The pivoting seat (13) has a pivoting hole (131), a sliding channel (132) and a positioning detent (133). The pivoting hole (131) is formed transversely through the pivoting seat (13). The sliding channel (132) is formed in a top surface of the pivoting seat (13). The positioning detent (133) is formed in the sliding channel (132). The lid (14) is covered on the top surface of the mounting disc (12) and is mounted around the pivoting seat (13).

Figure 3:
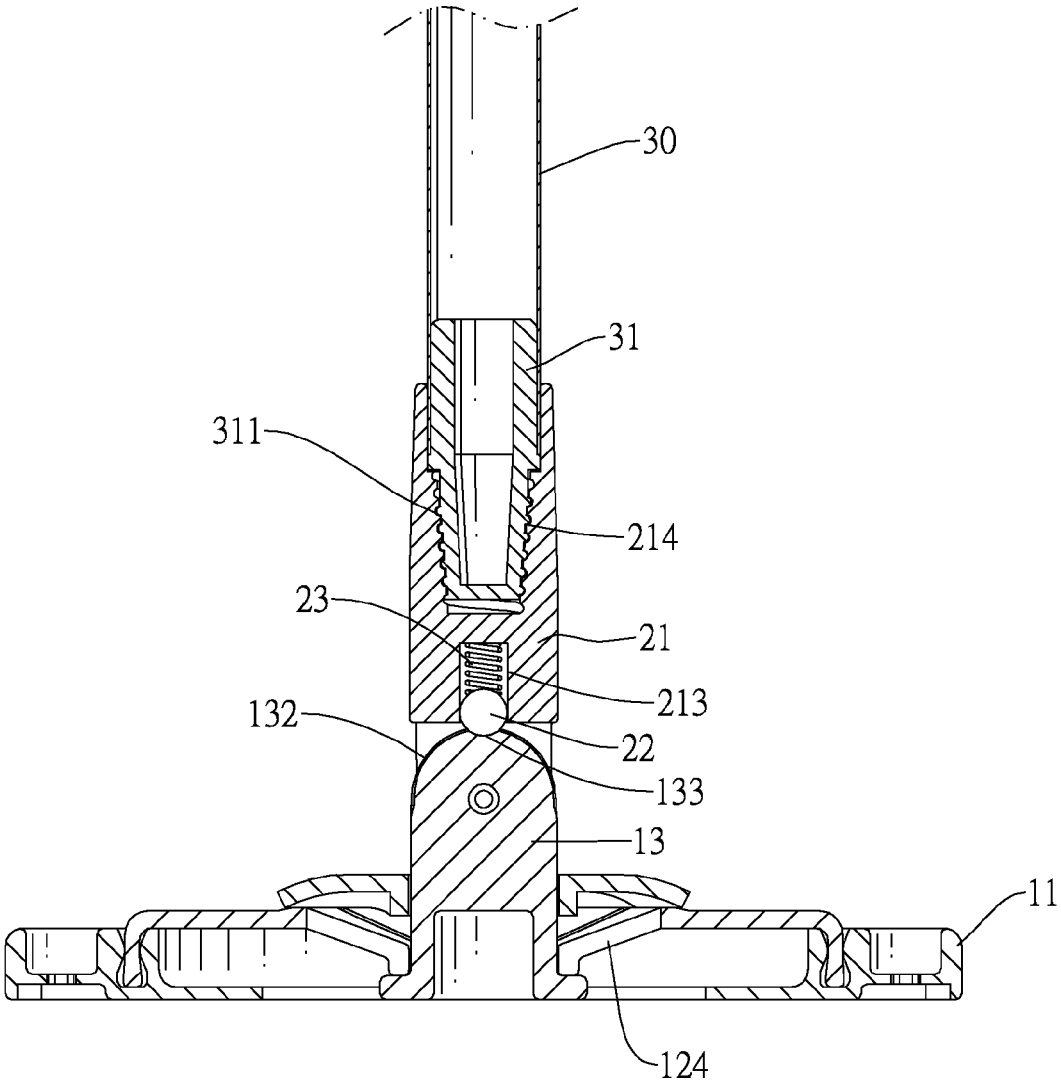
FIG. 3 is an operational partially side view in partial section of the self-rotating mop in FIG. 1, shown the connecting rod being perpendicular with the mop head.

With reference to FIGS. 2 and 3, the pivoting assembly (20) is connected to the mop head (10) and comprises a pivoting sleeve (21), a spring (23) and a ball (22). The pivoting sleeve (21) is mounted pivotally around the pivoting seat (13) and has a transversely pivoting hole (211), a mounting recess (213) and a threaded hole (214). A pin (212) is mounted through the pivoting holes (131, 211) of the pivoting seat (13) and the pivoting sleeve (21) to pivotally mount the pivoting sleeve (21) around the pivoting seat (13). The mounting recess (213) is formed in a bottom end of the pivoting sleeve (21). The threaded hole (214) is formed in a top end of the pivoting sleeve (21). The spring (23) and the ball (22) are mounted in the mounting recess (213) in sequence. The ball (22) protrudes out the mounting recess (213) and is pressed by the spring (23) to mounted slidably in the sliding channel (132) of the pivoting seat (13) and to selectively engage the positioning detent (133) of the pivoting seat (13).

Figure 4:
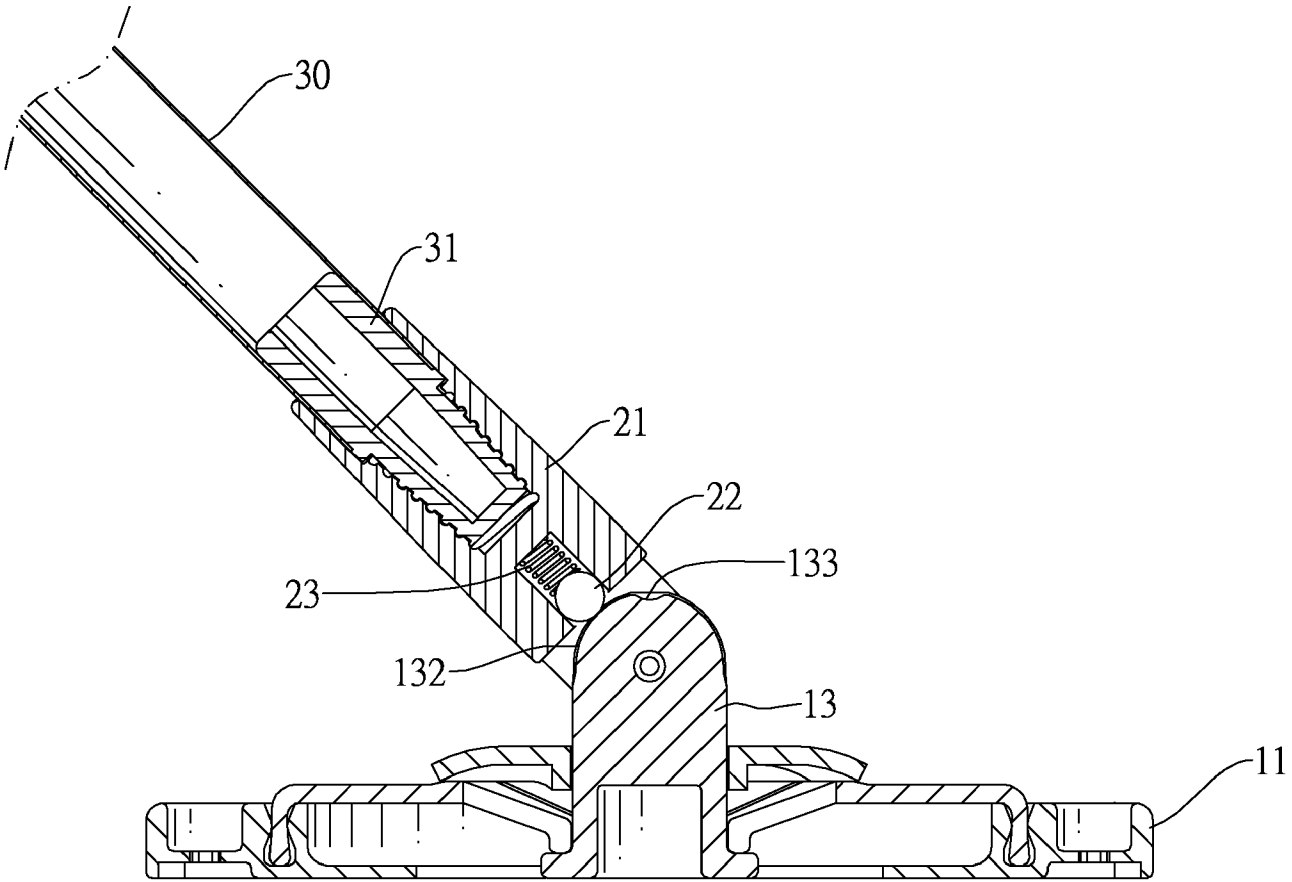
FIG. 4 is an operational partially side view in partial section of the self-rotating mop in FIG. 1, shown the connecting rod being inclined relative to the mop head.

With further reference to FIGS. 3 and 4, when the pivoting sleeve (21) is pivoted relative to the pivoting seat (13), the ball (22) slides along the sliding channel (132) of the pivoting seat (13) to restrict the pivoting path of the pivoting sleeve (21).

With reference to FIGS. 2 and 3, the connecting rod (30) is connected securely to the pivoting assembly (20) and may have a bottom plug (31) with outer threads (311). The bottom plug (311) is screwed into the threaded hole (214) of the pivoting sleeve (21).

Figure 12:
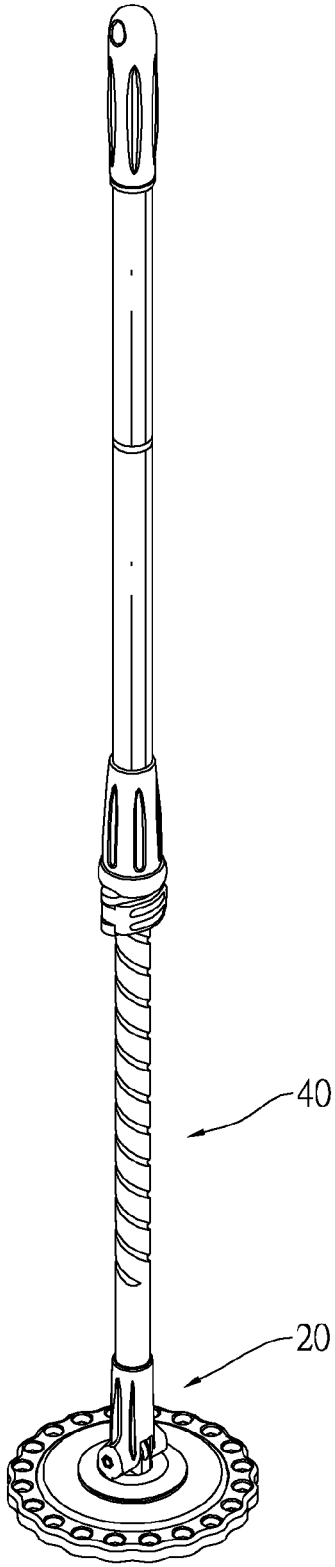
FIG. 12 is a perspective view of another embodiment of a self-rotating mop in accordance with the present invention.

With reference to FIG. 1, the rotating rod (40) is mounted securely around the connecting rod (30) and has a spiral channel (42) formed around an outside wall thereof. A connecting sleeve (41) may be mounted around the interface between the rotating rod (40) and the connecting rod (30). In another embodiment shown in FIG. 12, the rotating rod (40) is mounted on the pivoting assembly (20).

Figure 5:
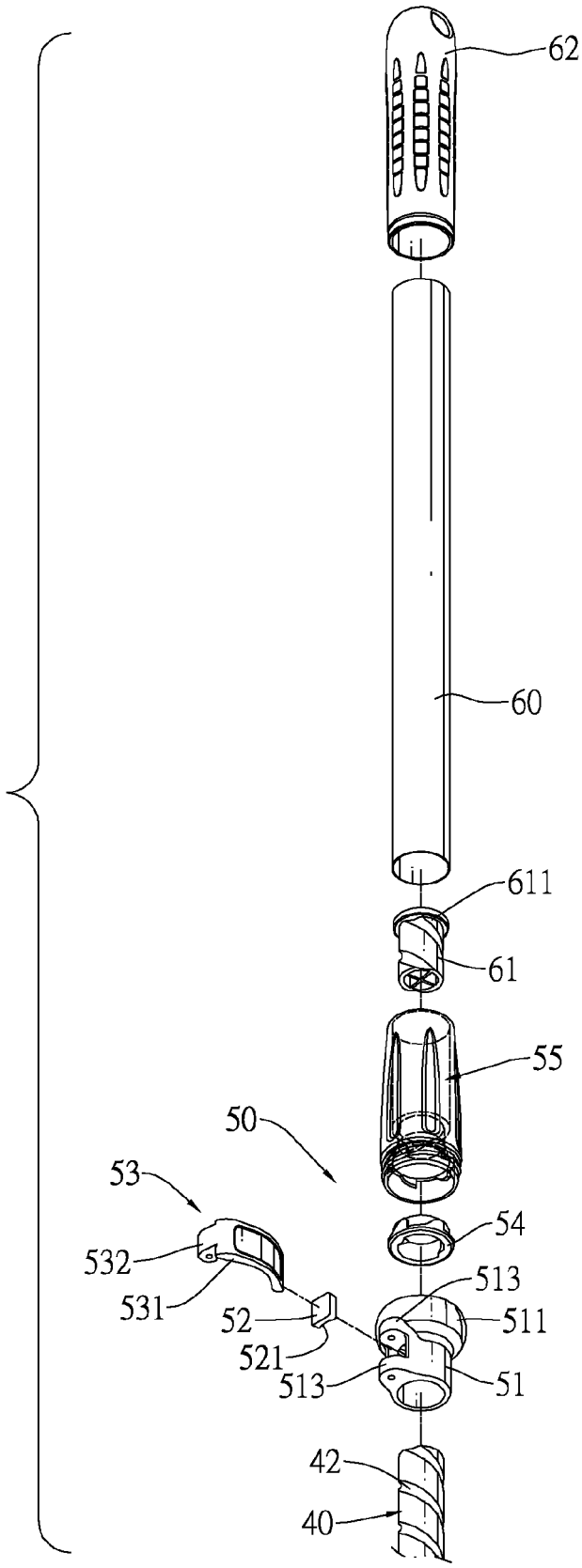
FIG. 5 is a partially exploded perspective view of the self-rotating mop in FIG. 1.

With reference to FIG. 5, the actuating assembly (50) is connected to the rotating rod (40) and comprises a mounting sleeve (51), a positioning assembly, an actuating ring (54) and an actuating sleeve (55).

Figure 6:
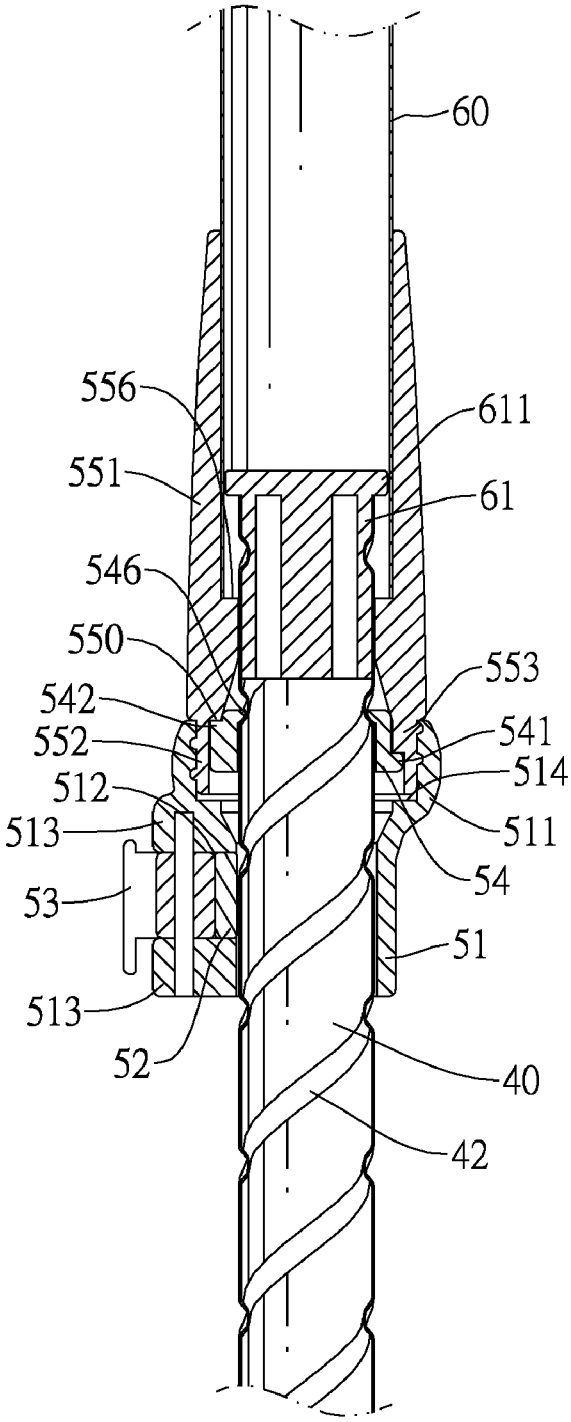
FIG. 6 is an operational partially side view in partial section of the self-rotating mop in FIG. 1, shown the actuating sleeve engaging with the actuating ring.

With reference to FIGS. 5 and 6, the mounting sleeve (51) is hollow, is mounted rotatably around the rotating rod (40) and has a top end openings, a bottom end opening, a body, an enlarged head (511), a pore (512) and a pivoting element. The enlarged head (511) is formed around the top end opening and is wider than the body to form a shoulder (514) between the enlarged head (511) and the body inside the mounting sleeve (51). The pore (512) is formed transversely through a sidewall of the mounting sleeve (51). The pivoting element is formed on the sidewall of the mounting sleeve (51) and may have two pivoting protrusions (513). The pivoting protrusions (513) separately protrudes transversely out from the sidewall of the mounting sleeve (51), are located at a periphery of the pore (512) and are opposite to each other.

Figure 7:
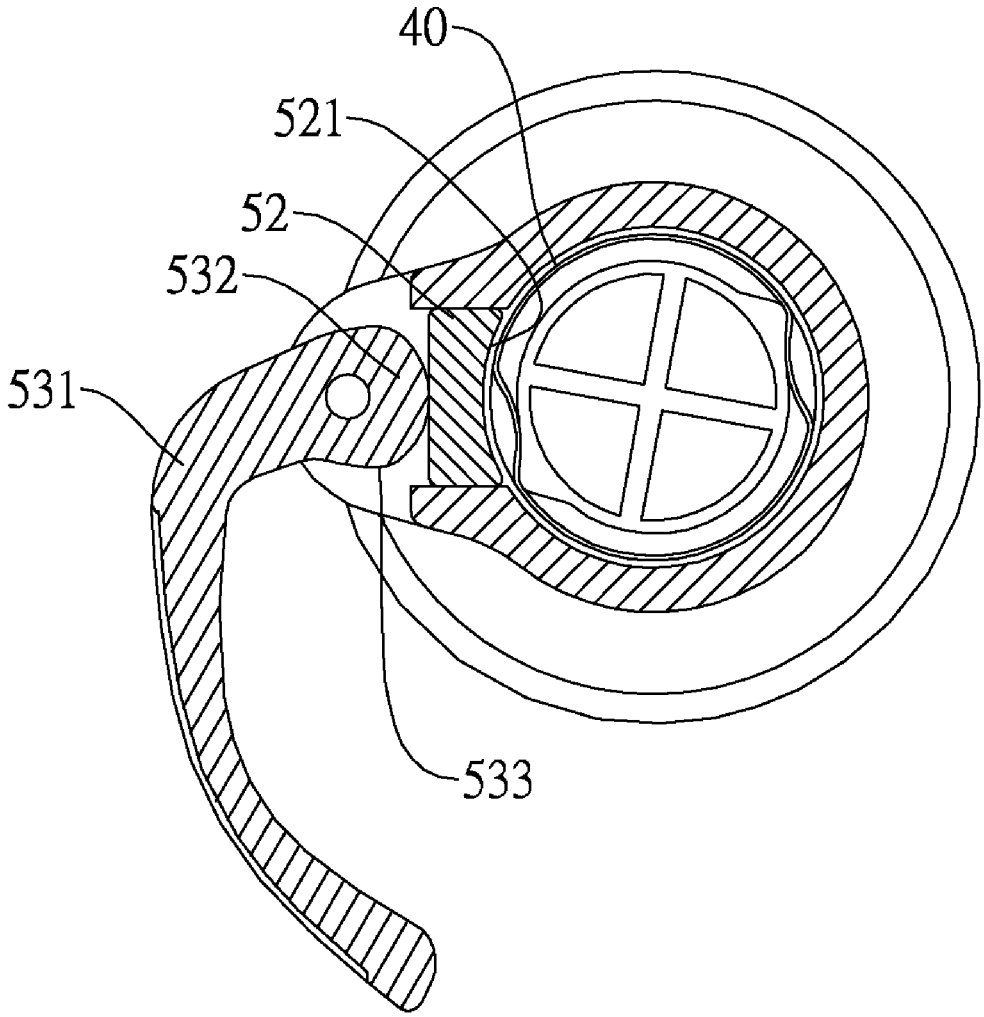
FIG. 7 is an operational partially bottom view in partial section of the self-rotating mop in FIG. 1, shown the lever pivoted outward.

With further reference to FIGS. 5 and 7, the positioning assembly is connected to the mounting sleeve (51) to selectively keep the rotating rod (40) from rotating. The positioning assembly may have an abrasion segment (52) and a lever (53). The abrasion segment (52) is mounted through the pore (512) of the mounting sleeve (51) and abuts against the rotating rod (40). The abrasion segment (52) may have a curved surface (521) abutting the rotating rod (40) and may be made of wear-resisting material such as lining. The lever (53) is connected pivotally to the mounting sleeve (51) and has a lever body (531) and a pivoting segment (532). The pivoting segment (532) is formed on an end of the lever body (531), is connected pivotally to the pivoting element of the mounting sleeve (51) and abuts against the abrasion segment (52). The pivoting segment (532) may be mounted across the pivoting protrusions (513). The pivoting segment (532) has a positioning protrusion (533) extending out from a sidewall of the pivoting segment (532). The sidewall of the pivoting segment (532) and the positioning protrusion (533) of the pivoting segment (532) alternatively abut the abrasion segment (52).

Figure 8:
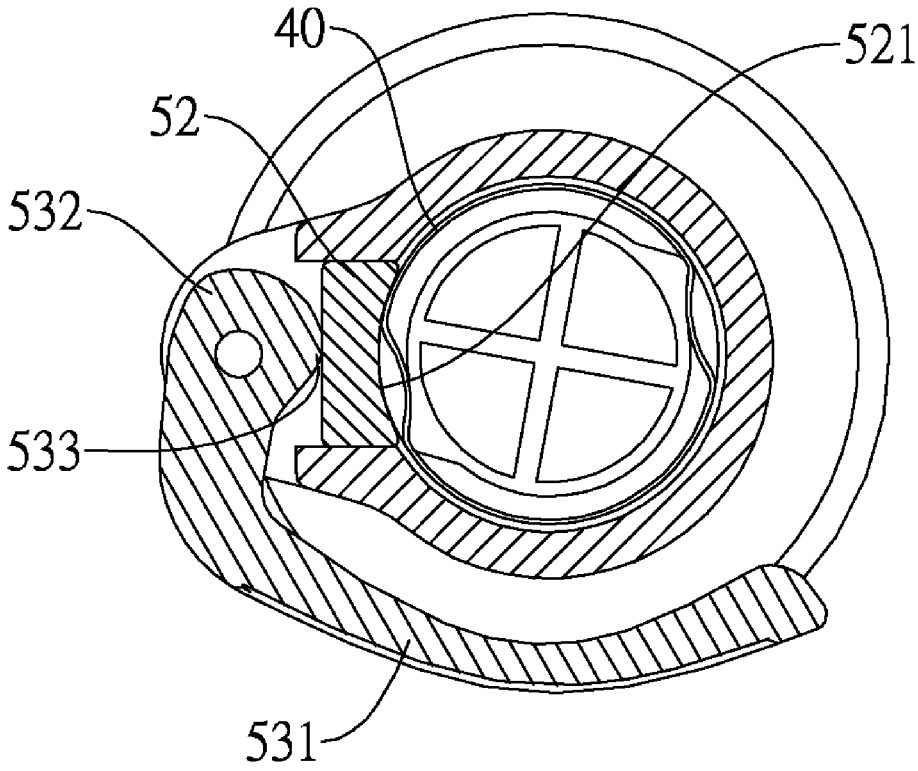
FIG. 8 is an operational partially bottom view in partial section of the self-rotating mop in FIG. 1, shown the lever pivoted inward.

By the cooperation between the lever (53) and the abrasion segment (52), the rotating rod (40) is selectively rotatable or non-rotatable. With reference to FIG. 7, when the sidewall of the pivoting segment (532) abuts the abrasion segment (52), the abrasion segment (52) does not press the rotating rod (40) so that the rotating rod (40) is rotatable. With reference to FIG. 8, the lever (53) is pivoted to make the positioning protrusion (533) abut the abrasion segment (52). The abrasion segment (52) is pushed to press tightly against the rotating rod (40). The rotating rod (40) is held by the abrasion segment (52) so that the rotating rod (40) is non-rotatable.

Figure 9:
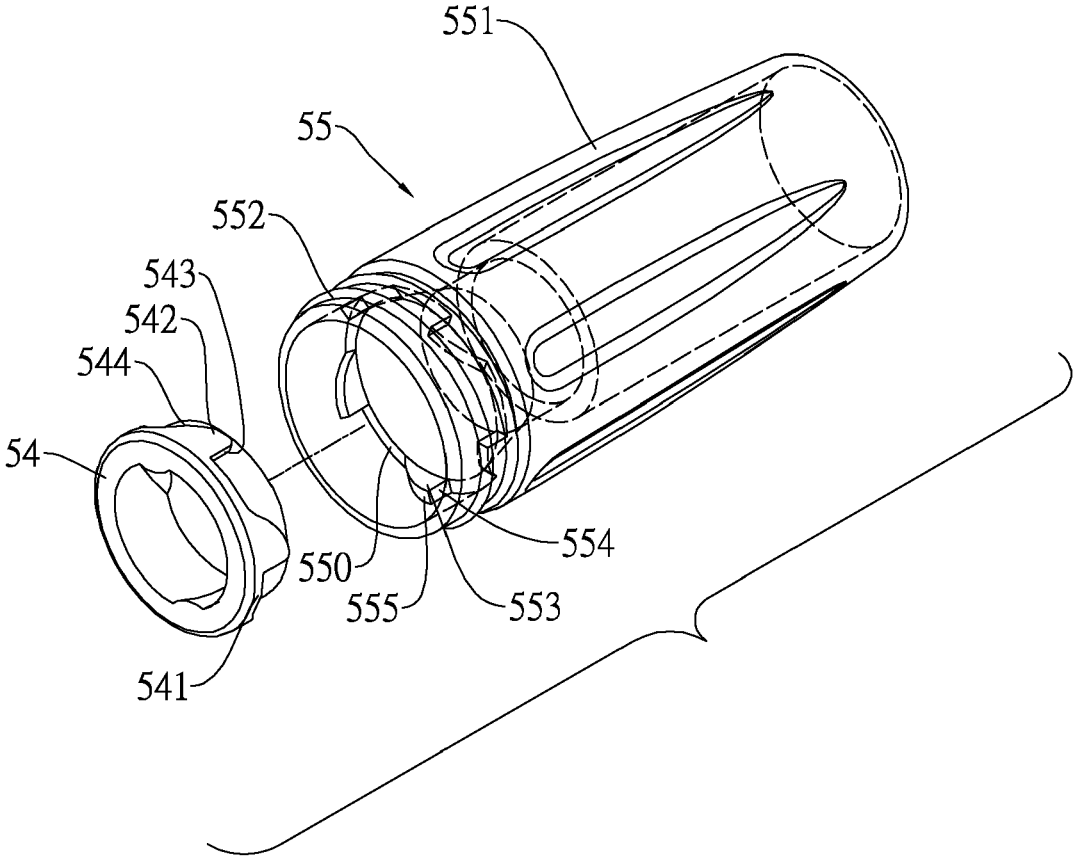
FIG. 9 is an exploded perspective view of the actuating sleeve and the actuating ring of the self-rotating mop in FIG. 1.
Figure 10:
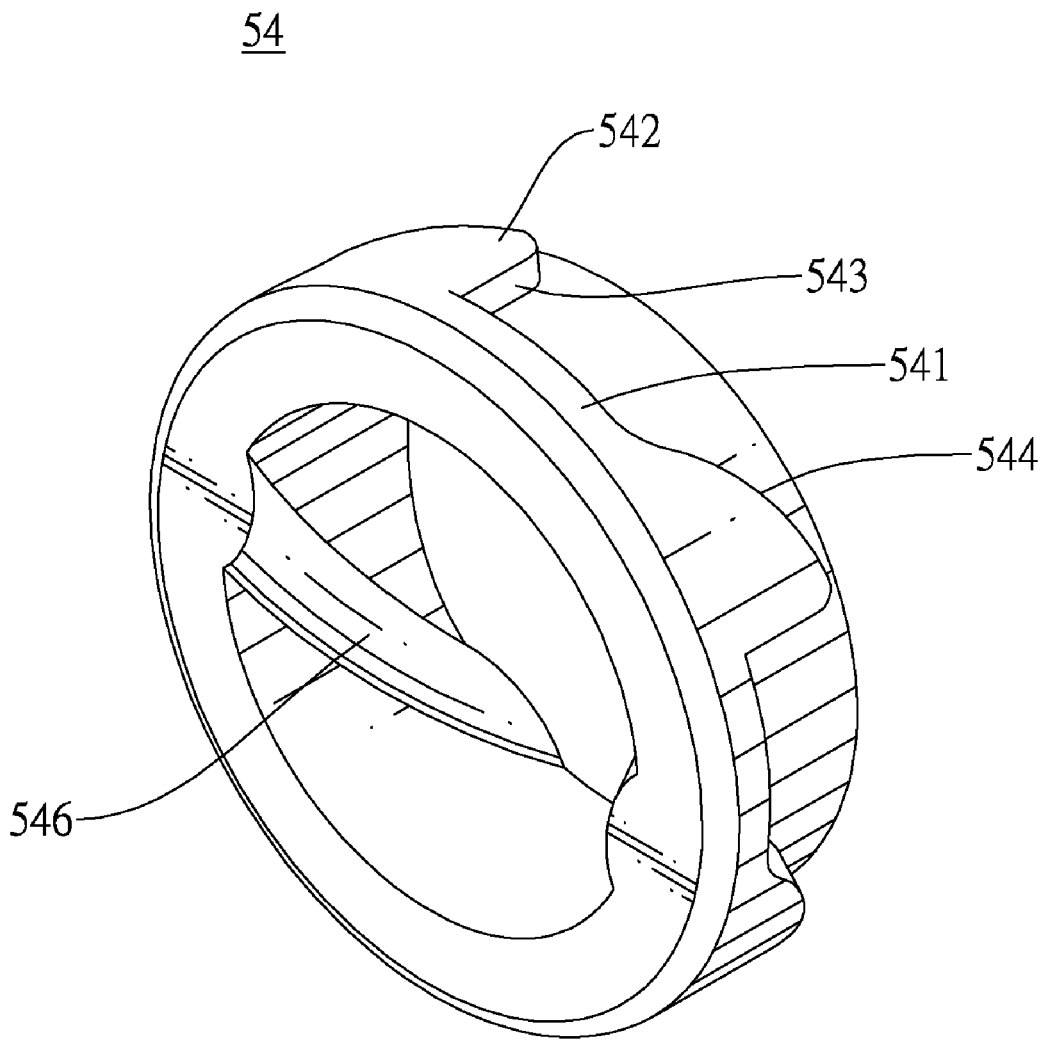
FIG. 10 is a perspective view of the actuating ring of the self-rotating mop in FIG. 1.

With reference to FIGS. 5, 9 and 10, the actuating ring (54) is mounted in the mounting sleeve (51) and may be mounted in the enlarged head (511) of the mounting sleeve (51). The actuating ring (54) is mounted around the rotating rod (40) and has a flange (541), multiple lower ratchets (542) and multiple curved ribs (546). The flange (541) is formed annularly around an outside wall of the actuating ring (54) and is formed adjacent to a bottom end of the actuating ring (54). The lower ratchets (542) are formed separately on the outside wall of the actuating ring (54). Each lower ratchet (542) has a straight side (543) and a curved side (544). The curved ribs (546) are separately formed obliquely on an inside wall of the actuating ring (54) and engage with the spiral channel (42) of the rotating rod (40).

With reference to FIGS. 5, 6 and 9, the actuating sleeve (55) is connected to the rotating rod (40) and the mounting sleeve (51) and has a main part (551), an end part (552) an a shoulder (550). The main part (551) is mounted around the rotating rod (40) and has a stepped surface (556) formed on an inside wall of the main part (551). The outer diameter of the main part (551) may be narrower from one end to the other end. The end part (552) is formed on an end of the main part (551), protrudes into the mounting sleeve (51) and is mounted between the mounting sleeve (51) and the actuating ring (54). The end part (552) may have outer threads to screed on to the inner thread of the mounting sleeve (51). The shoulder (550) is formed between the main part (551) and the end part (552). The actuating ring (54) is moved between the shoulders (514, 550) of the mounting sleeve (51) and the actuating sleeve (55). Multiple upper ratchets (553) are formed separately on an inside wall of the end part (552) and selectively engage with the lower ratchets (542) of the actuating ring (54). Each upper ratchet (553) has a straight side (554) and a curved side (555).

The top pole (60) is mounted securely into the main part (551) of the actuating sleeve (55) and is mounted around the rotating rod (40). A bottom end of the top pole (60) abuts the stepped surface (556) of the main part (551). A grip (62) is mounted around a top end of the top pole (60), may be made of soft material and may have uneven outside surface for easily holding. A top plug (61) is mounted in the top pole (60) and is mounted securely into a top end of the rotating rod (40). The top plug (61) has an annular flange (611) selectively abutting the top end of the rotating rod (40) to restrict axial movement of the rotating rod (40). When annular flange (611) abuts the stepped surface (556), the rotating rod (40) is kept from departing from the top pole (60) and the actuating assembly (50) and the top pole (60) is located at highest position. When the top surface of the top plug (61) abuts the grip (62), the top pole (60) is located at lowest position. The top pole (60) is restricted between the highest and lowest positions.

With reference to FIGS. 1, 6 and 9, the bristles (111) needs to spin to get rid of the redundant water. The top pole (60) is pushed downward (60) to simultaneously move the actuating sleeve (55) and the mounting sleeve (51) downward relative to the rotating rod (40) and the actuating ring (54). Then the upper ratchets (553) of the actuating sleeve (55) engage with the lower ratchets (542) of the actuating ring (54). The top pole (60) is continually pushed downward. The actuating ring (54) is stopped by the shoulder (550) of the actuating sleeve (55) so that the actuating ring (54) cannot keep moving upward relatively, and the actuating ring (54) is held by the upper ratchets (553) so that the actuating ring (54) cannot rotate. Therefore, continually pushing the top pole (60) forces the rotating rod (40) to rotate via the engagement between the spiral channel (42) and the curved rib (546). Thus, the rotating rod (40) is rotated and moved upward simultaneously and further rotates the mop head (10).

Figure 11:
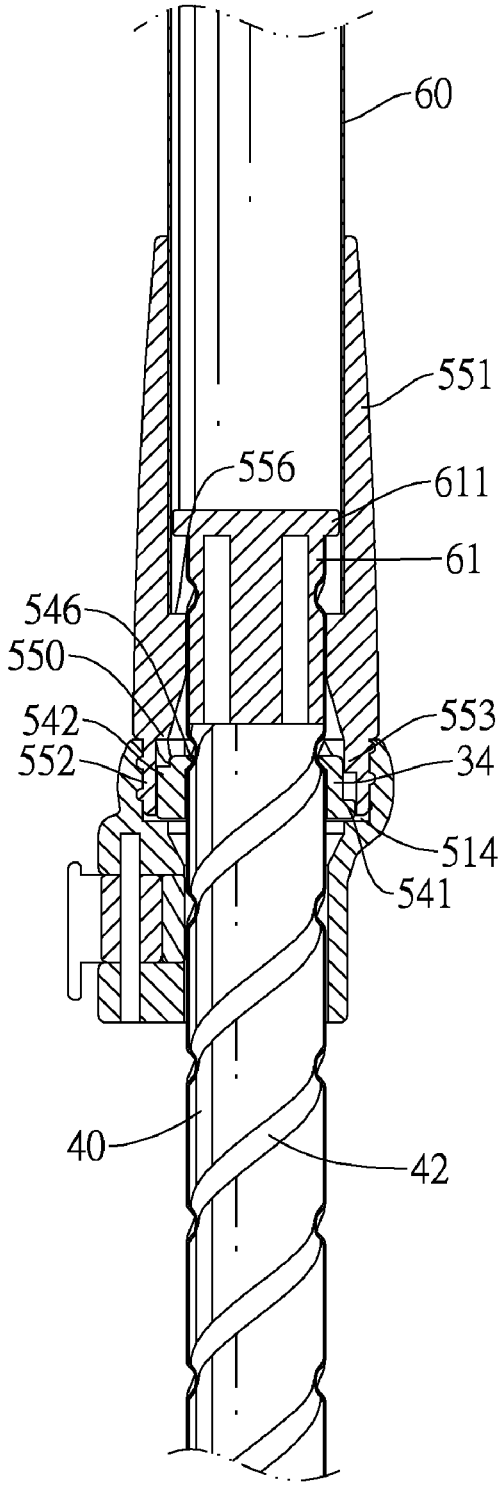
FIG. 11 is an operational partially side view in partial section of the self-rotating mop in FIG. 1, shown the actuating sleeve disengaging from the actuating ring.

With reference to FIGS. 1, 6 and 11, when the top pole (60) is pulled upward, the top pole (60) pulls the mounting sleeve (51) and the actuating sleeve (55) to move upward. The upper ratchets (553) disengage from the lower ratchets (542) to allow the actuating ring (54) rotatable. Continually pulling the top pole (60) to move upward makes the annular flange (541) of the actuating ring (54) abut the shoulder (514) of the mounting sleeve (51) and to pull the actuating ring (54) to move upward. Since the actuating ring (54) is rotatable, the actuating ring (54) is rotated and moved upward via the engagement between the spiral channel (42) and the curved rib (546). Therefore, the top pole (60) is pulled back until reaches the highest position.

With reference to FIGS. 1, 6, 8 and 9, the self-rotating mop as described is used for cleaning. The lever (53) is pivoted to force the abrasion segment (52) to keep the rotating rod (40) from rotating. Therefore, even a downward force acts on the top pole (60) while cleaning, the rotating rod (40) is non-rotatable to keep the top pole (60) from moving axially.

The self-rotating mop as described has following advantages. Simply with cooperation between the actuating sleeve (55) and the actuating ring (54), the mop head (10) is rotatable. Therefore, the whole structures of the self-rotating mop as described are reduced to cut the manufacturing cost and the assembling time.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A self-rotating mop comprising:

a mop head with multiple bristles mounted at a bottom thereof;

a pivoting assembly mounted on the mop head;

a rotating rod connected to the pivoting assembly and has a spiral channel formed on an outside wall thereof;

an actuating assembly connected to the rotating rod and comprising a hollow mounting sleeve mounted rotatably around the rotating rod and having two end openings;

a positioning assembly connected to the mounting sleeve to selectively keep the rotating rod from rotating;

an actuating ring mounted in the mounting sleeve, mounted around the rotating rod and having multiple lower ratchets formed separately on an outside wall of the actuating ring; and multiple curved ribs separately formed obliquely on an inside wall of the actuating ring and engaging with the spiral channel of the rotating rod; and an actuating sleeve connected to the rotating rod and the mounting sleeve and having a main part; and an end part formed on an end of the main part;

multiple lower ratchets formed separately on an inside wall of the end part and selectively engaging with the lower ratchets of the actuating ring; and a top pole mounted securely into the main part of the actuating sleeve and mounted around the rotating rod.

2. The self-rotating mop as claimed in claim 1, wherein the mounting sleeve has a body; and an enlarged head formed around the top end opening and is wider than the body to form a shoulder between the enlarged head and the body inside the mounting sleeve;

the actuating sleeve has a shoulder formed between the main part and the end part; and the actuating ring is mounted in the enlarged head of the mounting sleeve and moved between the shoulders of the mounting sleeve and the actuating sleeve.

3. The self-rotating mop as claimed in claim 2 further comprising a top plug, wherein the main part of the actuating sleeve having a stepped surface formed on an inside wall of the main part;

a bottom end of the top pole abuts the stepped surface;

the top plug is mounted in the top pole, is mounted securely into a top end of the rotating rod and has an annular flange selectively abutting the top end of the rotating rod.

4. The self-rotating mop as claimed in claim 3, wherein the mounting sleeve has a pore formed transversely through a sidewall of the mounting sleeve; and a pivoting element formed on the sidewall of the mounting sleeve; and the positioning assembly has an abrasion segment mounted through the pore of the mounting sleeve and abutting against the rotating rod; and a lever connected pivotally to the mounting sleeve and having a lever body; and a pivoting segment formed on an end of the lever body, connected pivotally to the pivoting element of the mounting sleeve and having a sidewall and a positioning protrusion extending out from the sidewall of the pivoting segment, whereby the sidewall of the pivoting segment and the positioning protrusion of the pivoting segment alternatively abut the abrasion segment.

5. The self-rotating mop as claimed in claim 4, wherein the pivoting element of the mounting sleeve has two pivoting protrusions separately protruding transversely out from the sidewall of the mounting sleeve, located at a periphery of the pore and being opposite to each other; and the pivoting segment of the lever mounted across the pivoting protrusions.

6. The self-rotating mop as claimed in claim 5, wherein the mop head has a pivoting seat protruding upward and having a sliding channel formed in a top surface of the pivoting seat;

the pivoting assembly comprising a pivoting sleeve mounted pivotally around the pivoting seat and having a mounting recess formed in a bottom end of the pivoting sleeve;

a spring mounted in the mounting recess; and a ball pressed by the spring, mounted in and protruding out the mounting recess and mounted slidably in the sliding channel of the pivoting seat.

7. The self-rotating mop as claimed in claim 6, wherein the pivoting seat has a positioning detent formed in the sliding channel; and the ball selectively engages the positioning detent.

8. The self-rotating mop as claimed in claim 7, wherein the mop head comprising a base having a central hole;

a mounting channel formed annularly in a top surface of the base and formed around the central hole; and multiple holding protrusions formed in the mounting channel in pairs;

a mounting disc covered on the top surface of the base and having a sidewall protruding into the mounting channel of the base and clamped by the holding protrusions;

two grooves formed annularly in an inner surface and an outer surface of the sidewall of the mounting disc and engaging with the holding protrusions of the base;

a central hole aligning with the central hole of the base; and multiple pawls formed separately on and protruding transversely from an inside wall around the central hole of the mounting disc; and a lid covered on the top surface of the mounting disc and mounted around the pivoting seat;

the bristles are mounted on a bottom of the base; and the pivoting seat is mounted through the central hole of the mounting disc, protruding through a top surface of the mounting disc and clamped between ends of the pawls.

9. The self-rotating mop as claimed in claim 6, wherein the mop head comprising a base having a central hole;

a mounting channel formed annularly in a top surface of the base and formed around the central hole; and multiple holding protrusions formed in the mounting channel in pairs;

a mounting disc covered on the top surface of the base and having a sidewall protruding into the mounting channel of the base and clamped by the holding protrusions;

two grooves formed annularly in an inner surface and an outer surface of the sidewall of the mounting disc and engaging with the holding protrusions of the base;

a central hole aligning with the central hole of the base; and multiple pawls formed separately on and protruding transversely from an inside wall around the central hole of the mounting disc; and a lid covered on the top surface of the mounting disc and mounted around the pivoting seat;

the bristles are mounted on a bottom of the base; and the pivoting seat is mounted through the central hole of the mounting disc, protruding through a top surface of the mounting disc and clamped between ends of the pawls.

10. The self-rotating mop as claimed in claim 1, wherein the mounting sleeve has a pore formed transversely through a sidewall of the mounting sleeve; and a pivoting element formed on the sidewall of the mounting sleeve; and the positioning assembly has an abrasion segment mounted through the pore of the mounting sleeve and abutting against the rotating rod; and a lever connected pivotally to the mounting sleeve and having a lever body; and a pivoting segment formed on an end of the lever body, connected pivotally to the pivoting element of the mounting sleeve and having a sidewall and a positioning protrusion extending out from the sidewall of the pivoting segment, whereby the sidewall of the pivoting segment and the positioning protrusion of the pivoting segment alternatively abut the abrasion segment.

11. The self-rotating mop as claimed in claim 10, wherein the pivoting element of the mounting sleeve has two pivoting protrusions separately protruding transversely out from the sidewall of the mounting sleeve, located at a periphery of the pore and being opposite to each other; and the pivoting segment of the lever mounted across the pivoting protrusions.

12. The self-rotating mop as claimed in claim 1, wherein the mop head has a pivoting seat protruding upward and having a sliding channel formed in a top surface of the pivoting seat;

the pivoting assembly comprising a pivoting sleeve mounted pivotally around the pivoting seat and having a mounting recess formed in a bottom end of the pivoting sleeve;

a spring mounted in the mounting recess; and a ball pressed by the spring, mounted in and protruding out the mounting recess and mounted slidably in the sliding channel of the pivoting seat.

13. The self-rotating mop as claimed in claim 12, wherein the pivoting seat has a positioning detent formed in the sliding channel; and the ball selectively engages the positioning detent.

14. The self-rotating mop as claimed in claim 13, wherein the mop head comprising a base having a central hole;

a mounting channel formed annularly in a top surface of the base and formed around the central hole; and multiple holding protrusions formed in the mounting channel in pairs;

a mounting disc covered on the top surface of the base and having a sidewall protruding into the mounting channel of the base and clamped by the holding protrusions;

two grooves formed annularly in an inner surface and an outer surface of the sidewall of the mounting disc and engaging with the holding protrusions of the base;

a central hole aligning with the central hole of the base; and multiple pawls formed separately on and protruding transversely from an inside wall around the central hole of the mounting disc; and a lid covered on the top surface of the mounting disc and mounted around the pivoting seat;

the bristles are mounted on a bottom of the base; and the pivoting seat is mounted through the central hole of the mounting disc, protruding through a top surface of the mounting disc and clamped between ends of the pawls.

15. The self-rotating mop as claimed in claim 12, wherein the mop head comprising a base having a central hole;

a mounting channel formed annularly in a top surface of the base and formed around the central hole; and multiple holding protrusions formed in the mounting channel in pairs;

a mounting disc covered on the top surface of the base and having a sidewall protruding into the mounting channel of the base and clamped by the holding protrusions;

two grooves formed annularly in an inner surface and an outer surface of the sidewall of the mounting disc and engaging with the holding protrusions of the base;

a central hole aligning with the central hole of the base; and multiple pawls formed separately on and protruding transversely from an inside wall around the central hole of the mounting disc; and a lid covered on the top surface of the mounting disc and mounted around the pivoting seat;

the bristles are mounted on a bottom of the base; and the pivoting seat is mounted through the central hole of the mounting disc, protruding through a top surface of the mounting disc and clamped between ends of the pawls.

16. The self-rotating mop as claimed in claim 1 further comprising a connecting rod connecting pivotally to the mop head, wherein the pivoting assembly mounted between the mop head and the connecting rod to allow the connecting rod pivoting relative to the mop head; and the rotating rod mounted securely around the connecting rod.

* * * * *